US008328013B2

(12) United States Patent
Stevens

(10) Patent No.: US 8,328,013 B2
(45) Date of Patent: Dec. 11, 2012

(54) PAINT TOOL EQUIPMENT BOX AND KIT

(76) Inventor: Timothy Stevens, Davison, MI (US)

( * ) Notice: Subject to any disclaimer, the term of this patent is extended or adjusted under 35 U.S.C. 154(b) by 0 days.

(21) Appl. No.: 13/291,190

(22) Filed: Nov. 8, 2011

(65) Prior Publication Data

US 2012/0175278 A1 Jul. 12, 2012

Related U.S. Application Data

(60) Provisional application No. 61/430,766, filed on Jan. 7, 2011.

(51) Int. Cl.
*B65D 85/28* (2006.01)

(52) U.S. Cl. ..... 206/373; 206/486

(58) Field of Classification Search ..... 206/446, 206/486, 488, 490, 562, 361, 229, 362, 362.2, 206/362.3

See application file for complete search history.

(56) References Cited

U.S. PATENT DOCUMENTS

| | | | | | |
|---|---|---|---|---|---|
| 3,643,812 | A * | 2/1972 | Mander et al. | 211/74 |
| 4,303,158 | A * | 12/1981 | Perkins | 206/373 |
| 4,932,533 | A * | 6/1990 | Collier | 206/569 |
| 5,333,751 | A * | 8/1994 | Santucci, Sr. | 206/423 |
| 5,370,263 | A * | 12/1994 | Brown | 220/751 |
| 5,505,303 | A | 4/1996 | Sirman | |
| 5,526,929 | A * | 6/1996 | Wei | 206/378 |
| 5,544,744 | A * | 8/1996 | Oman | 206/319 |
| 5,615,782 | A * | 4/1997 | Choe | 211/70.6 |
| 5,645,091 | A * | 7/1997 | Hoeft | 134/84 |
| 5,738,241 | A * | 4/1998 | McEntee | 220/532 |
| 5,941,381 | A * | 8/1999 | James | 206/229 |
| 6,926,151 | B1 | 8/2005 | Perry | |
| 7,275,641 | B1 | 10/2007 | Purnell | |
| 7,337,901 | B2 | 3/2008 | Phillips | |
| 7,854,321 | B2 * | 12/2010 | Twig et al. | 206/373 |
| 2008/0179215 | A1 * | 7/2008 | Arvin | 206/581 |
| 2009/0101539 | A1 * | 4/2009 | Qian et al. | 206/763 |

* cited by examiner

*Primary Examiner* — Steven A. Reynolds
*Assistant Examiner* — King M Chu
(74) *Attorney, Agent, or Firm* — Global Intellectual Property Agency, LLC

(57) ABSTRACT

An organizer for securely retaining paint tools, materials and other accessories, particularly where tools must be organized in an upright configuration and made conveniently available for a user to access. The device comprises a container with an interior volume, an interior shelf having apertures suitable for retaining paint tools and an open base surface for placement of upstanding tubes for insertion of paint roller and similar tools. The individual components of the organizer may be available as a kit to allow a user to customize any desired storage container, or preferably the assembly is provided in a specific configuration for retaining paint tools in a predefined fashion.

8 Claims, 3 Drawing Sheets

PAINT TOOL EQUIPMENT BOX AND KIT

CROSS REFERENCE TO RELATED APPLICATION

This application claims the benefit of U.S. Provisional Application No. 61/430,766 filed on Jan. 7, 2011, entitled "Paint Equipment Box."

BACKGROUND OF THE INVENTION

1. Field of the Invention

The present invention relates to a tool box for carrying, organizing and storing tools. More specifically the present invention is designed to address tool organization needs of painters, with specific attachment points, holders and storage means for devices used in painting operations.

Currently there are few devices available for consumers and professional painters to neatly and compactly organize and store tools prior to commencing a project. Painters generally require a great number of tools and accessories to complete a given project properly, including different sized brushes, rollers and applicators. Organizing these devices in a single location can be difficult. These tools are often discarded or lost after their use, as the tools are scattered and improperly handled between jobs. This can be wasteful and time consuming, as new tools need to be purchased to replace the missing items.

Therefore a need arises for a compact and convenient storage device for housing and transporting painting tools and materials. The device must comprise the ability to accommodate a variety of painting tools and applicators, while storing them in a compact and neatly organized fashion. The device must further be easy to handle and transport, allowing a user to transport the tools between job sites with ease. The present invention provides a device that fulfills these needs by providing a modular, compact and utilitarian tool box that provides a plurality of securing means for common paint tools, including paint rollers, brushes, spatulas, sponges, stirring sticks and the like. The present invention provides retainment means within a container such that the tools and paint equipment are positioned in a vertical configuration, facilitating easy access to and easy removal of each item from the container.

2. Description of the Prior Art

Several patents have been issued that describe inventions related to tool organizers and toolboxes. However, these devices suffer from several drawbacks, or fail to address the issues of organizing a plurality of different painter's tools as provided by the present invention. While general tool storage is a goal of the present invention, the device is particularly adapted to organize painter specific tools in a vertical fashion and reduce time required to locate items or realize a lost or misplaced tool. The issue of tool location and organization of paint tools is not addressed by the prior art devices.

Several patents have issued related to standard toolboxes designed to store small tools. Perkins, U.S. Pat. No. 4,303,158 is directed to a toolbox for small hand tools and associated items that opens up from the front as well as the top, and is provided with supporting elements for holding certain tools contained therein in an upright position. There is provided a built-in storage compartment and a front cover hingedly connected at its bottom edge to a front plate and which includes a strip magnet on its inside surface on which metal tools may be affixed and stored. The device further includes a shelf having a plurality of holes into which can be inserted tools and suspended therein in an upright position is mounted inside the tool box near the top and a removable tray having adjustable compartments seated on a shelf inside the tool box near the bottom. A pullout drawer having adjustable compartments is located underneath the tray.

Similarly, Perry, U.S. Pat. No. 6,926,151 is directed to a tool holder convertible between storage and display configurations as well as a method of manufacture therefor. In one embodiment, the tool holder includes a flexible wrapper including first and second parallel major and minor edges and a fold line located in between. The Perry tool holder is adapted to provide a flexible storage carrier for a plurality of paint tools, including a series of brushes. The flexible carrier can be folded onto itself for improved storage or transport of the attached items.

Further, Purnell, U.S. Pat. No. 7,275,641 is directed to an organizer for securely retaining hand tools and other miscellaneous items, particularly in environments where working space is limited and the tools must be kept organized and convenient. The organizer includes a container adapted for the insertion and support of various items such as hand tools. A support panel may be hinged for pivoting to an open position to provide access to the interior compartment for tool storage. Either the top wall or the front wall of the organizer are adapted to be opened and retracted for access to the interior and support plate of the organizer.

The Perkins, Perry and Purnell patents disclose devices for the general organization and transport of tools. While providing adequate means for general projects, these devices are not designed to address the particular needs and desires of a painter. The present invention addresses these needs, allowing a painter to efficiently and conveniently store, transport, organize and locate the tools and materials required for painting projects. The structure and scope of the aforementioned patents also fail to describe the present invention elements or key features.

Other patents are directed to carrying toolboxes that are designed for other applications and projects. Sirman, U.S. Pat. No. 5,505,303 is directed to a toolbox apparatus that is used to carry and store the tools and equipment commonly used by individuals who work with plaster or drywall. The toolbox apparatus of the Sirman invention includes a first wall that is parallel to a second wall, an opened top and an enclosed bottom. The first portion includes a plurality of parallel slots for receiving and maintaining blades' typically used for drywall installation. The second portion of the device includes a compartment that is used for storing other commonly used items by individuals who drywall. While the Sirman device provides a means of transportion and organization for tools, it does so in the context of tools that are used for drywall installation. Such tools fit an entirely different profile with regard to those used by painters, thus the Sirman device does not address the same issues or needs as those of the present invention.

Alternatively, Phillips U.S. Pat. No. 7,337,901 is directed to an organizer attachable to the rim of a bucket, comprising a rounded end conforming to the rim of the bucket. The device fits onto the bucket such that a handle of the bucket freely rotates to a position in a plane above the organizer from the rounded end side of the bucket when the organizer is attached to the bucket and a second end opposite the rounded end cantilevers over the other side of the bucket. The organizer comprises one or more compartments having at least one of a solid floor and one or more openings. The Phillips device is designed as a modification to a traditional bucket that allows the storage and organization of tools and other materials. However, the Phillips invention is not optimized to be suitable for painters and their unique variety of tools and materials.

Rollers in particular would likely not be suitable for storage in the Phillips device. The present invention addresses this need, by providing a storage means customized for painters and their tools and materials.

The inventions addressed in the prior patents describe devices for the transportation and storage of general tools, or tools specific to drywall installation. There is a need in the art for a device that can easily store and transport painting tools that further allows the user to organize and determine at a glance if there are missing tools or materials. The present invention fulfills this need by providing a painter's tool box that is adapted to accommodate typical tools and applicators used in painting. Its structure substantially diverges in design elements from the prior art and consequently it is clear that there is a need in the art for an improvement to existing tool box devices. In this regard the instant invention substantially fulfills these needs.

SUMMARY OF THE INVENTION

In view of the foregoing disadvantages inherent in the known types of tool organizers now present in the prior art, the present invention provides a new paint tool organizer and carrier wherein the same can be utilized for providing convenience for the user when organizing and maintaining painting tools and devices in a compact and transportable container.

The present invention provides a customizable storage and transport container for paint tools. The device is a container that includes several different interior tool retainers and organizers that can be positioned in a configuration to suit the user. These retainers and organizers include upstanding tubes to accommodate paint rollers and other elongated tools, as well as shelving that extends around the inner perimeter of the container to retain tools and articles in an upright position. The container device provides professionals and individuals with an organization means for painting accessories and tools, and one that can provide access and visualization of the tools prior to and during the performance of a task.

It is therefore an object of the present invention to provide a new and improved paint roller cleaning device that has all of the advantages of the prior art and none of the disadvantages.

Another object of the present invention to provide an easy to utilize device for the organization, storage and transport of home project supplies and tools. More specifically, it is a further object of the present invention to be customized for the needs and tools of those involved in painting projects, and in particular provide a means of storing painting supplies and tools in an upright configuration and in a colocated container.

Another object of the present invention is to provide an efficient means of storing supplies and tools, such that the amount, presence and condition of each article can be verified without necessarily removing the tool prior to beginning a project, preventing lost or missing items prior to initiating work that may lead to unnecessary work interruptions.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself, and manner in which it may be made and used, may be better understood by referring to the following description taken in connection with the accompanying drawings.

DETAILED DESCRIPTION OF THE INVENTION

Figure 1:
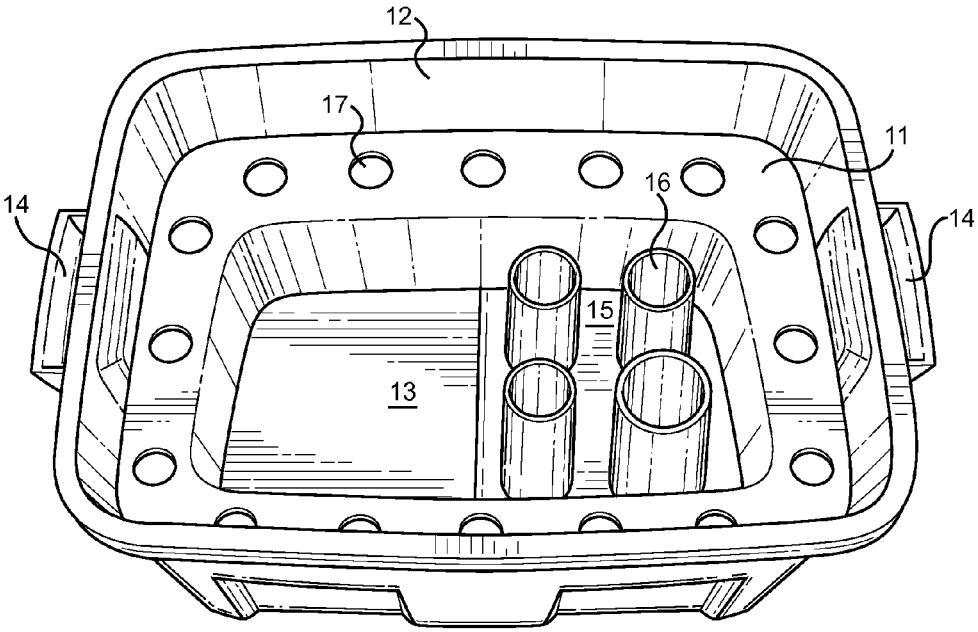
FIG. 1 is an overhead perspective view of the present invention with its lid in an open position and vertical tool support tubes are provided in a removable configuration.

Reference is made herein to the attached drawings. Like reference numerals are used throughout the drawings to depict like or similar elements of the paint equipment organizer. For the purposes of presenting a brief and clear description of the present invention, the preferred embodiment will be discussed as used for organization painting tools and similar devices. The figures are intended for representative purposes only and should not be considered to be limiting in any respect.

Figure 2:
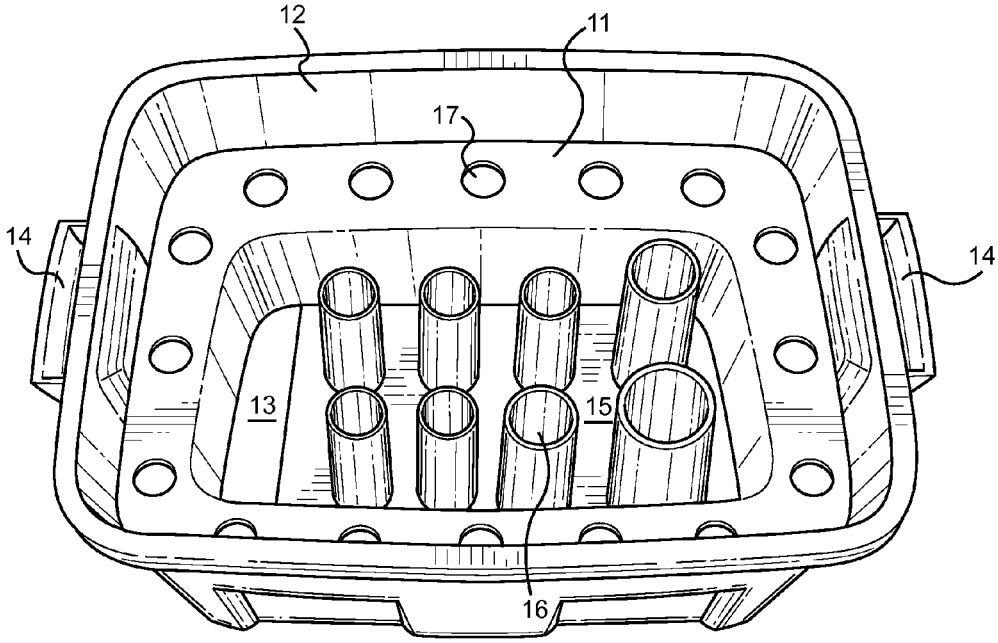
FIG. 2 is another overhead perspective view of the present invention with its lid in an open position and vertical tool support tubes are provided in a removable configuration.

Referring now to FIG. 1 and FIG. 2, there are shown overhead perspective views of a first embodiment of the present invention in which upstanding tool support tubes 16 are provided within a cavity of tool container and are positioned on a removable platform 15. The platform 15 provided in this embodiment provides a portion 13 of the storage space left unoccupied and for general usage. The body of the container comprises an outer wall 12, two opposing handle grips 14 and a flat lower surface 13 to which the walls 12 attach. The shape of the container may take any desirable shape or size to fit the user preference. The upper perimeter of the container walls is equipped with a rim to allow attachment of a lid as desired by the user. The handles 14 allow the device to be carried by a single user when filled or empty.

Figure 4:
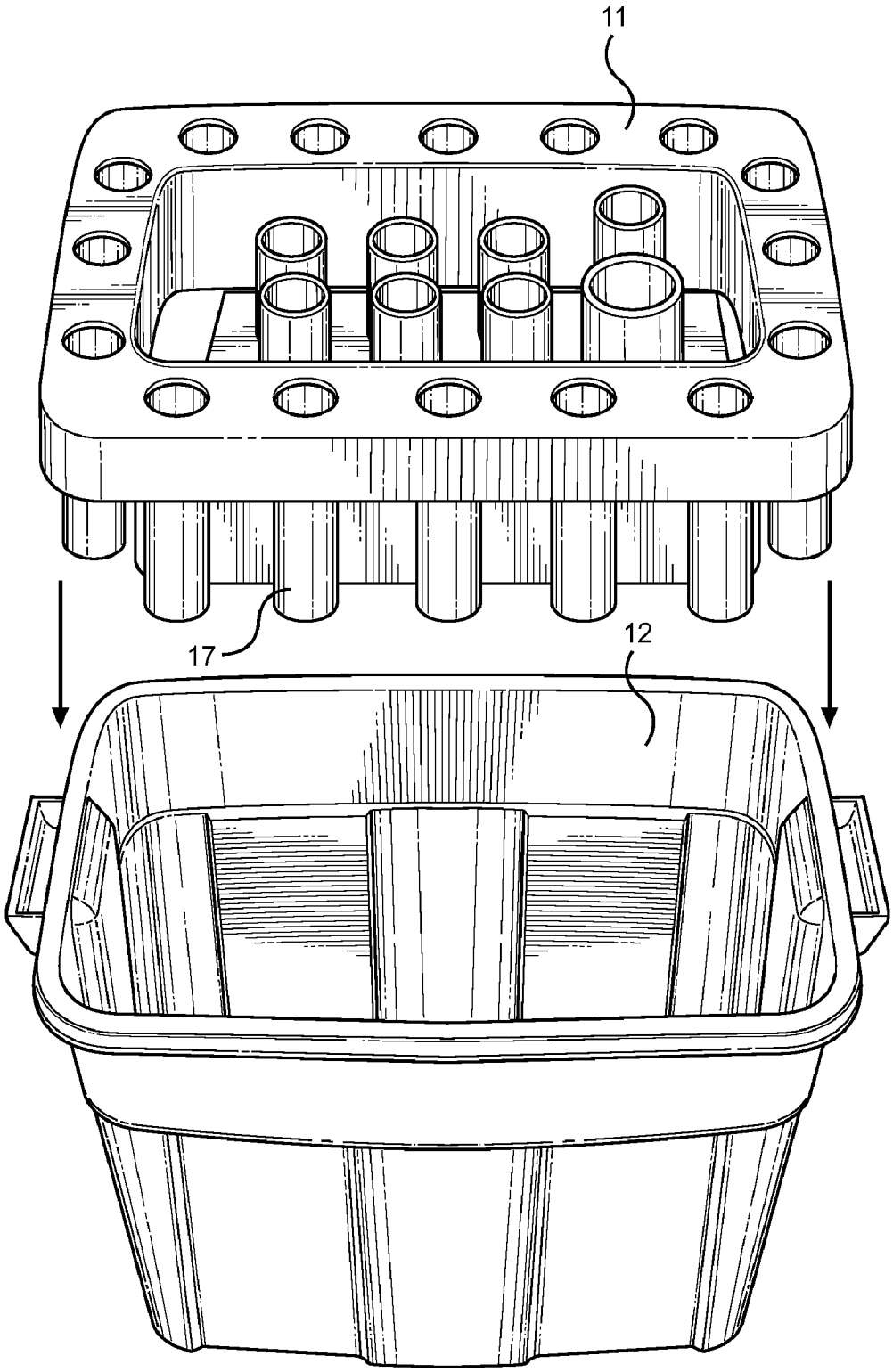
FIG. 4 is a perspective view of an alternate embodiment of the present invention wherein the removable shelf is inserted into the container.

Along the interior perimeter of the container is provided a raised shelf 11 that provides a plurality of tool and article holding apertures. The apertures are cylindrical cavities or depressions with a closed end, allowing insertion of tool articles and vertical retainment thereof without permitting the tool to fall through the cavity and behind the shelf. Along the base 13 of the container is provided a plurality of upstanding tubes 16 for which to similarly support paint roller or other articles in an upright configuration. The vertical tubes 16 are cylindrical bodies that allow a tool to be placed within its interior volume, including paint rollers, stirrers, brushes and the like. The raised shelf 11 and vertical tubes 16 may be provided in one of two embodiments: molded into the container or alternatively placed therein with inherent removability, as shown in FIG. 4. The ability to remove the shelving and tubes allows the user to clean these articles separately, and to load or remove entire groups of articles at one time if desired. The removability of the inner components further improves the modularity of the container, allowing the user to configure the interior to his or her liking for a given task or storage need.

The vertical tubes, in the alternative embodiment, are provided on a common platform and may be affixed to the base surface using hook and loop fasteners, or alternatively be unsecured thereto, relying on the weight of the engaged tools to secure its location within the device. The goal of the present invention is to provide a modular tool housing, and one that can be tailored to meet the needs of a particular user. A portion of the device may also be left without tool retainers to allow the user to stow larger articles such as paint cans or personal items.

Figure 3:
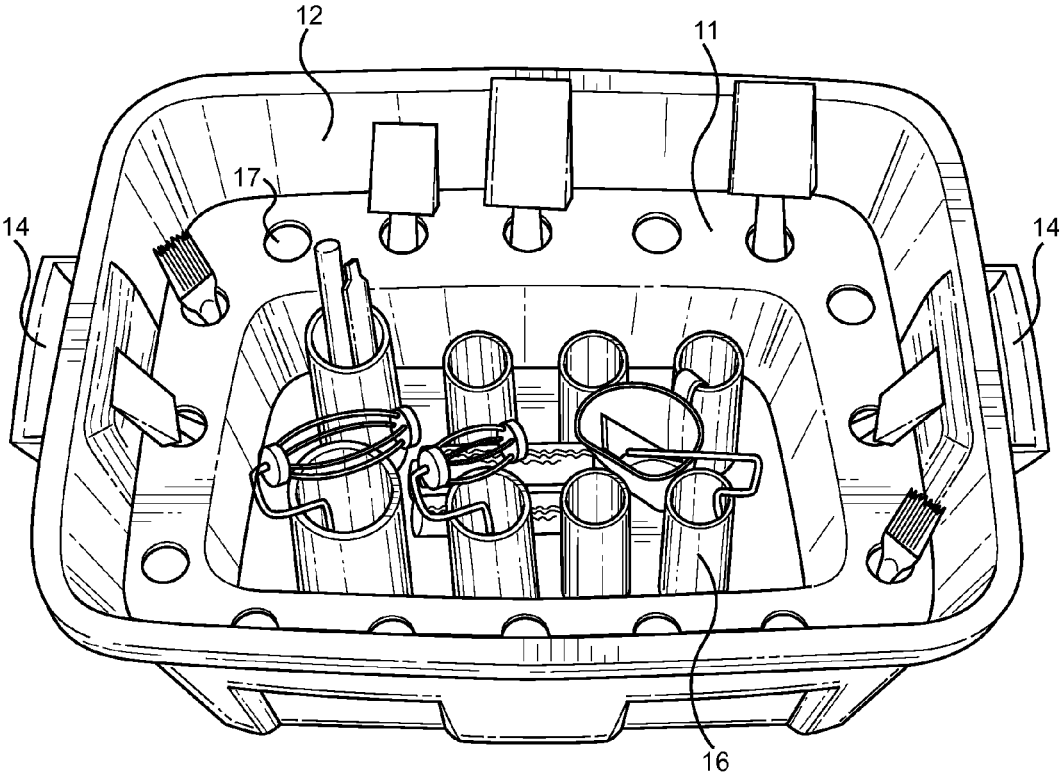
FIG. 3 is a perspective view of a second embodiment of the present invention, wherein the vertical tubes are integrated into the container structure.

Referring now to FIG. 3, there is shown a perspective view of the present invention in use, filled with painting tools and supplies. Handled tools such as paint brushes and applicators can be secured to the perimeter shelf portion 11, while larger handled tools and dowels, such as paint rollers and stirrers, can be placed within the upstanding tubes 16 along the interior of the device. Bulk items, such as masking tape, paint roller trays, and paint cans can be placed within an open section of the device if available. In this view, the alternate embodiment of the device is shown, wherein the shelving 11 and the upstanding tubes 16 are molded into the structure of the container. This may required a specific mold and provides a static configuration for the device; however it reduces part count, loose components and may reduce complexity. The goal is to provide a device that is an improvement to existing storage boxes, and one that provides organization of tools for a painter, while providing sufficient volume to accommodate a large array or number of tools in one location. The tools are organized in such a fashion to allow a practitioner to easily view, locate and remove a particular item or items during a project. The device also provides a means to quickly stow and colocate tools after a job is completed.

The present invention is a box used to store multiple tools, materials and accessories that can be used for painting. The device comprises a container of any generic shape with upstanding sidewalls and a lip for accepting a lid. The interior volume of the container may be customized with the aforementioned tool holder accessories, in a configuration that may suit the user. This configuration may be provided in different forms that the user may purchase, including different sized platforms having upstanding tubes or varying length shelving that maybe placed within the interior of the container for a user to create his or her own configuration with the accessories and a provided container. The materials utilized for the device may be any material suitable for durable tool boxes, and those that can be rinsed with water for cleaning. Materials preferred for the box include durable plastic, such that the container is sufficiently rigid and durable, while providing the ability to be rinsed clean once emptied of tools.

The device may be designed in a particular configuration during assembly, allowing a user to choose a specific configuration that best meets his or her needs. Alternatively, the device may be supplied as a kit to allow customization of the tool holding storage container. Such a case may provide vertical tubes affixable to the bottom surface of the case or pre-molded thereon. Overall the device is provided for individuals to conveniently organize tools in an upright configuration, allowing easy insertion and removal, as well as visual inspection of each tool within the container.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An organizer for securing, storing and transporting painting tools comprising:

a container having sidewalls, a container base surface, a perimeter and an upper rim;

an elongated and raised shelf within said container along said perimeter, wherein said shelf comprises a ridge connected to upper edges of an interior recess of the shelf, said recess having a recess base surface and at least one recess wall defining the boundary of said interior recess;

a plurality of apertures disposed along said shelf, wherein said apertures extend downward from said shelf into a space between said container sidewalls and said at least one recess wall; and one or a plurality of upstanding tubes disposed along to said recess base surface.

2. The device of claim 1, wherein said container further comprises a removable lid attachable to said upper rim and a pair of opposing handles along said container outer perimeter.

3. The device in claim 1, in which said upstanding tubes are positioned on a common platform that is positionable on said recess base surface and may be removed or relocated to allow a user to customize said container.

4. The device of claim 3, wherein said platform is affixable to said recess base surface for secure positioning thereof.

5. The device of claim 1, wherein said upstanding tubes are molded into said recess base surface.

6. The device in claim 1, wherein said shelf is removably positionable within said container allowing a user to customize said container.

7. The device of claim 1, wherein said shelf is molded into said container.

8. The device of claim 1, wherein said shelf apertures are closed, cylindrical depressions within said shelf.

* * * * *